US006290816B1

(12) United States Patent
Graf

(10) Patent No.: US 6,290,816 B1
(45) Date of Patent: Sep. 18, 2001

(54) PAPER MACHINE WITH CLOSED LOOP CONTROL SYSTEM

(75) Inventor: Edwin X. Graf, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/358,722

(22) Filed: Jul. 21, 1999

(51) Int. Cl.[7] ..... D21F 7/00

(52) U.S. Cl. ..... 162/253; 162/254; 162/DIG. 10; 162/198; 162/262; 162/252; 162/263; 162/258; 162/259; 700/127; 700/129

(58) Field of Search ..... 162/253, 254, 162/DIG. 10, 198, 262, 252, 263, 258, 259; 700/127, 129

(56) References Cited

U.S. PATENT DOCUMENTS 5,715,158 * 2/1998 Chen ..... 364/150

6,086,716 * 7/2000 Watson ..... 162/198

* cited by examiner

*Primary Examiner*—Stanley S. Silverman
*Assistant Examiner*—M. Halpern
(74) *Attorney, Agent, or Firm*—Taylor & Aust, P.C.

(57) ABSTRACT

A paper machine for making a fiber web includes an approach flow system with a plurality of control modules. Each control module controls one of a plurality of adjustable input parameters. A wet end receives a fiber suspension from the approach flow system, and includes a headbox which discharges a fiber suspension with a known cross sectional profile onto a wire. A press section, forming section and drying section are used to press form and dry the fiber web, respectively. A plurality of sensors are respectively positioned in association with the approach flow system, wet end, press section, forming section and/or drying section. Each sensor is configured to sense a physical characteristic of the fiber suspension or fiber web and provide an output signal indicative thereof. A chemistry process controller is coupled with each sensor and each control module within the approach flow system to define a closed loop control system. The chemistry process controller controls operation of each control module.

12 Claims, 2 Drawing Sheets

PAPER MACHINE WITH CLOSED LOOP CONTROL SYSTEM

BACKGROUND OF THE INVENTION

1. Field of the Invention

The present invention relates to paper machines, and, more particularly, to a control system used to control physical components of the paper machine.

2. Description of the Related Art

A paper machine receives a prepared fiber suspension and produces a fiber web, such as a paper web. The physical parameters of the fiber suspension which is supplied to the paper machine, such as the pressure, temperature, chemical content, etc. in turn affect the physical characteristics of the fiber web manufactured by the paper machine. It is known to laboratory test a small portion of the fiber web to determine the physical characteristics thereof. After the fiber web is tested, valves, feed screws, pumps or the like may be manually actuated to add a predetermined amount of energy (e.g., heat) or chemical (e.g., calcium carbonate, titanium dioxide, etc.) to the fiber suspension to affect the physical characteristics of the manufactured web. Since this process is manually adjusted, the delay time between obtaining a sample of paper and finally adjusting a device within the approach flow system may be extensive. This means that a relatively large amount of paper may be produced which does not have optimum physical characteristics.

What is needed in the art is a paper machine which automatically adjusts for at least some of the physical parameters associated with the fiber suspension to thereby improve the quality of the fiber web.

SUMMARY OF THE INVENTION

The present invention provides a chemical process controller which receives input signals from a plurality of sensors spaced along the length of the paper machine, and which controls various control modules of an approach flow system which provides a fiber suspension to a wet end of the paper machine.

The invention comprises, in one form thereof, a paper machine for making a fiber web, including an approach flow system including a plurality of control modules. Each control module controls one of a plurality of adjustable input parameters. A wet end receives a fiber suspension from the approach flow system and includes a headbox which discharges a fiber suspension with a known cross sectional profile onto a wire. A press section, forming section and drying section are used to press, form and dry the fiber web, respectively. A plurality of sensors are respectively positioned in association with the approach flow system, wet end, press section, forming section and/or drying section. Each sensor is configured to sense a physical characteristic of the fiber web and provide an output signal indicative thereof. A chemistry process controller is coupled with each sensor and each control module within the approach flow system to define a closed loop control system. The chemistry process controller controls operation of each control module.

An advantage of the present invention is that the physical parameters of the fiber suspension are controlled using a closed loop control system, thereby avoiding the necessity to manually adjust valves, pumps or the like.

A further advantage is that output signals from the sensors may be utilized almost instantaneously to provide a fiber suspension with desired physical parameters to the wet end of the paper machine.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
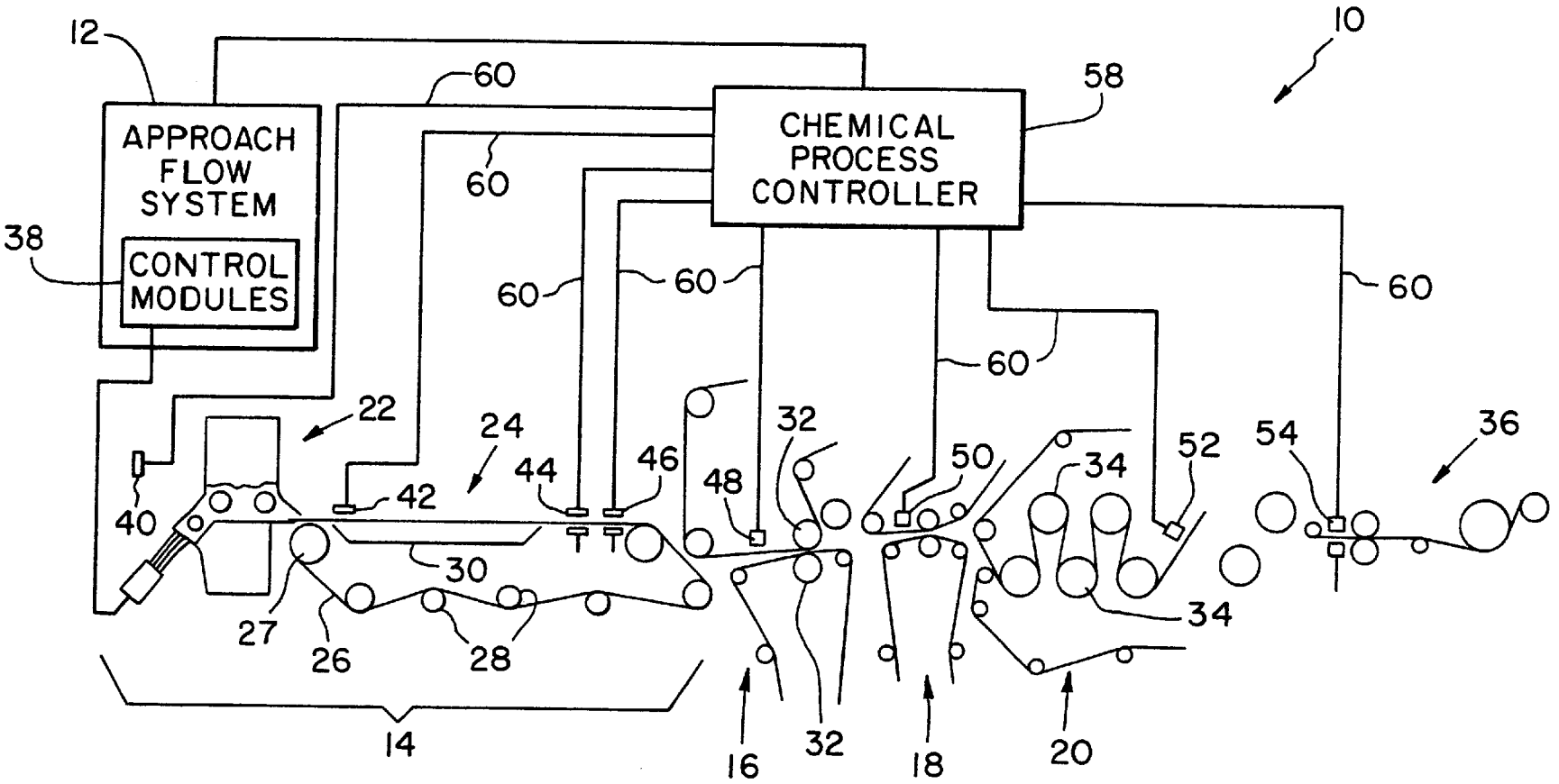
FIG. 1 is a schematic, side view of an embodiment of a paper machine of the present invention.

Referring now to the drawings, and more particularly to FIG. 1, there is shown an embodiment of a paper machine 10 of the present invention for making a fiber web, such as a paper web. Paper machine 10 generally includes an approach flow system 12, wet end 14, press section 16, forming section 18 and drying section 20.

Wet end 14 includes a headbox 22 and a fordrinier section 24. Headbox 22 receives a prepared fiber suspension from approach flow system 12, and discharges the fiber suspension with a controlled cross sectional profile from a discharge outlet onto a wire 26 of fordrinier section 24. Fordrinier section 24 also includes a couch roll 27 positioned adjacent to the discharge outlet of headbox 22. Couch roll 27 may be moved in an oscillatory manner in an axial direction (perpendicular to the drawing of FIG. 1) to induce a fluid shear within the fiber suspension which is discharged onto wire 26. Wire 26 is carried by couch roll 27 and a plurality of rolls 28 in an endless matter. Water within the fiber suspension drains through wire 26 and is collected within a tray 30. The water collected within tray 30 may be recycled for further use within paper machine 10.

The fiber web is transferred from fordrinier section 24 to press section 16, including two press rolls 32. Press rolls 32 may be, e.g., in the form of extended nip press rolls or the like for pressing water from a fiber web. Press section 16 may include other pressing configurations, such as press shoes, etc.

Forming section 18 forms the fiber suspension to define a fiber web with a desired cross sectional profile. Forming section 18 may include a forming section with forming blades, etc. to form the cross sectional profile of the fiber web which travels therethrough.

Drying section 20 dries the fiber web to a desired moisture content before the web is wound into a roll. Drying section 20 includes a plurality of dryer cylinders 34 which heat and dry the fiber web, in known manner. A dried fiber web is transferred to a winding station 36 for winding the fiber web into a roll.

Approach flow system 12 provides a fiber suspension with predetermined physical properties to headbox 22 for formation of the fiber web. Approach flow system 12 includes a plurality of control modules 38 for controlling one or more adjustable input parameters which affect the physical characteristics of the fiber suspension which is supplied to headbox 22.

Control modules 38 can have varied configurations, and thus are indicated schematically in FIG. 1. Generally, control modules 38 are used to control or add a chemical which affects the physical properties of the fiber suspension. Alternatively, control modules 38 may include other devices for affecting the physical properties of the fiber suspension, such as a heat source which affects the viscosity of a fiber suspension, etc.

Conventionally, approach flow system 12 may include a manually adjustable valve or the like which is manually actuated to control the addition of a chemical or heat to the fiber suspension. Contrarily, control modules 38 of the present invention are electrically controllable to control the addition of heat or a chemical to the fiber suspension. For example, a control module 38 may be in the form of a steam valve to heat white water; a valve for adding sodium hydroxide (NaOH) to adjust a pH of the fiber suspension; a valve and/or screw feeder for adding calcium carbonate ($CaCO_3$); a valve for adding sulfuric acid ($H_2SO_4$); a valve for adding aluminum hydroxide ($Al_2H_2SO_4$); a valve and/or pump for adding a first retention additive; a valve and/or pump for adding a second retention additive; a valve for adding rosin size; or a valve and/or screw feeder for adding titanium dioxide ($TiO_2$).

Paper machine 10 also includes a plurality of sensors 40–54 which sense different physical characteristics of the fiber suspension or fiber web along the running length of paper machine 10. Sensors 40–54 may be, e.g., in the form of a pressure sensor, gamma backscatter sensor, ultrasound sensor, optical sensor, temperature sensor and/or flow meter, depending upon the particular physical characteristics of the fiber suspension and/or fiber web being sensed. For example, sensor 40 may be used to sense a fiber stock pH; stock temperature; zeta potential; consistency of the fiber suspension; total pressure head; flow rate of the fiber suspension to wet end 14; and/or percent of entrained air in the fiber stock. The zeta potential generally relates to an amount of electrical charge on the individual fibers within the fiber suspension, and indirectly relates to an amount of anionic trash within the fiber suspension.

Moreover, sensor 42 could be used to sense the formation of the fibers within the fibers suspension which is discharged onto wire 26; a traveling speed of wire 26; the consistency of the fiber suspension immediately after couch roll 27; and/or a flow rate of the water which is collected and transported away from tray 30. The formation of the fiber suspension relates to the orientation of the fibers within the fiber suspension, relative to the traveling direction of wire 26. The flow rate of the water within tray 30 correlates to the retention characteristics of the fibers within the fiber suspension provided by approach flow system 12.

Sensors 44–54 may likewise be used to sense physical characteristics associated with the fiber web which can be affected by the physical characteristics of the fiber suspension which is provided by approach flow system 12.

Chemical process controller 58 is coupled with and receives an input signal from each of sensors 40–54. More particularly, chemical process controller 58 is coupled with each sensor 40–54 via a corresponding electrical conductor 60. Chemical process controller 58 could also be coupled with one or more of sensors 40–54 in another suitable manner, such as by using an infrared (IR) link, etc.

Figure 2:
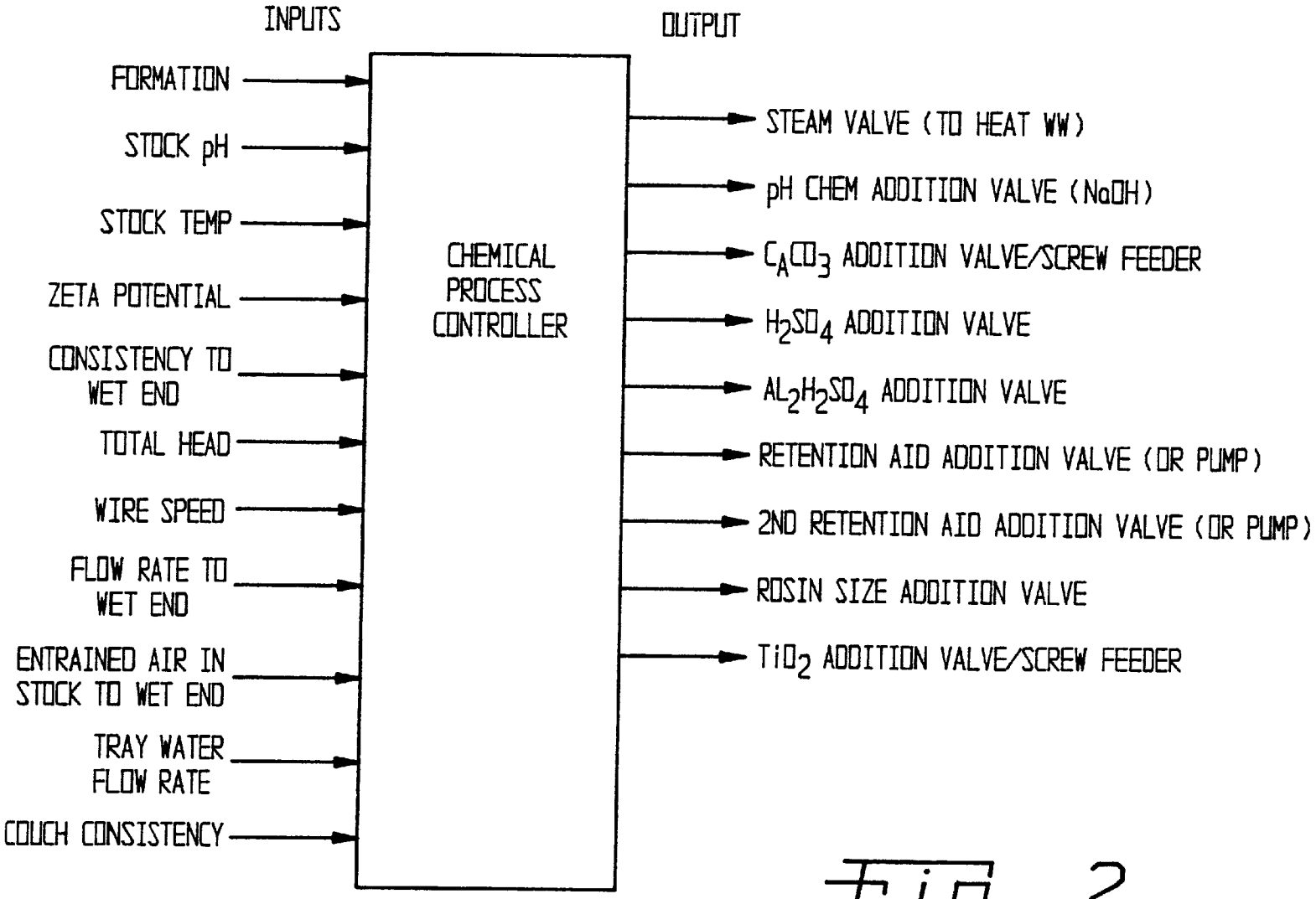
FIG. 2 is a graphical illustration of the inputs and outputs of the chemical process controller used in the paper machine of the present invention.

Chemical process controller 58 is also electrically connected with and controls operation of control modules 38 within approach flow system 12. More specifically, chemical process controller 58 receives input signals from sensors 40–54 and provides one or more output signals to one or more control modules 38 within approach flow system 12 (as shown schematically in FIG. 2). The control signals provided by chemical process controller 58 are used to actuate and/or controllably adjust operation of one or more control modules 38 to affect the physical characteristics and/or physical parameters (used synonymously to cover chemical and non-chemical related attributes) of the fiber suspension which is provided to headbox 22. In this manner, a closed loop control system is defined which better controls operation of paper machine 10 and provides a high quality fiber web as a final product. Since control modules 38 are electrically controlled via chemical process controller 58, approach flow system 12 preferably includes a plurality of control modules 38 to better control the physical parameters and/or physical characteristics of the fiber suspension provided to headbox 22. In the embodiment shown, approach flow system 12 includes three or more control modules 38. Controlling a single control module may not be effective since altering one input parameter may affect another (e.g., adding heat may affect a chemical reaction; adding one chemical may affect another chemical, etc.).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine for making a fiber web, comprising:

an approach flow system for providing a flow of a fiber suspension, said approach flow system including a plurality of control modules located therein and associated therewith, each said control module controlling a different one of a plurality of adjustable parameters related to the fiber suspension being provided thereby;

a wet end for receiving the fiber suspension from said approach flow system and initially forming the fiber web;

a press section including at least one press device for pressing water from the fiber web initially formed at said wet end;

a forming section including at least one forming device for defining a desired cross-sectional profile of the fiber web;

a drying section including at least one dryer for drying the fiber web to a desired moisture content;

a conveyor for transferring the fiber web through said wet end, said press section, said forming section and said drying section;

a plurality of sensors, each said sensor positioned in association with one of said approach flow system, said wet end, said press section, said forming section and said drying section, each said sensor configured to sense a physical characteristic of the fibers suspension or fiber web and provide a signal indicative of the physical characteristic sensed thereby; and a chemistry process controller coupled with each said sensor and each said control module to define a closed loop control system, said chemistry process controller controlling operation of each said control module.

2. The paper machine of claim 1, wherein each said control module comprises a different mechanism corresponding to said different adjustable parameter controlled thereby, each said different mechanism being one of:

a steam valve to heat white water;

a valve for adding NaOH to adjust a pH of the fiber suspension;

one of a valve and screw feeder for adding $CaCO_3$;

a valve for adding $H_2SO_4$;

a valve for adding $Al_2H_2SO_4$;

one of a valve and pump for adding a first retention additive;

one of a valve and pump for adding a second retention additive;

a valve for adding rosin size; and one of a valve and screw feeder for adding $TiO_2$.

3. The paper machine of claim 2, wherein said plurality of control modules comprises at least three control modules.

4. The paper machine of claim 1, wherein each of said plurality of sensors senses one of:

formation;

stock pH;

stock temperature;

zeta potential;

consistency to wet end;

total pressure head;

wire speed;

flow rate to wet end;

entrained air in stock;

tray water flow rate; and couch consistency.

5. The paper machine of claim 1, wherein each of said sensors comprises one of a pressure sensor, gamma backscatter sensor, ultrasound sensor, optical sensor, temperature sensor and flow meter.

6. The paper machine of claim 1, wherein said chemistry process controller is respectively coupled with each said sensor and each said control module via at least one electrical conductor.

7. The paper machine of claim 1, wherein said wet end includes a headbox, a couch roll and a wire carried by said couch roll.

8. A paper machine for making a fiber web, comprising:

an approach flow system including at least three control modules, each said control module controlling a different one of a plurality of adjustable parameters, each said adjustable parameter comprising one of: white water temperature, pH of the fiber suspension, $CaCO_3$ content, $H_2SO_4$ content, $Al_2H_2SO_4$ content, content of a first retention additive, content of a second retention additive, rosin size content and $TiO_2$ content, each said control module including a corresponding different mechanism for adjustment of said adjustable parameter corresponding thereto, each said different mechanism comprising one of: a steam valve to heat white water; a valve for adding NaOH to adjust a pH of the fiber suspension; one of a valve and screw feeder for adding $CaCO_3$; a valve for adding $H_2SO_4$; a valve for adding $Al_2H_2SO_4$; one of a valve and pump for adding a first retention additive; one of a valve and pump for adding a second retention additive; a valve for adding rosin size; and one of a valve and screw feeder for adding $TiO_2$;

a wet end for receiving a fiber suspension from said approach flow system and initially forming the fiber web;

a press section including at least one press for pressing water from the fiber web initially formed by said wet end;

a forming section at least one former for defining a desired cross-sectional profile of the fiber web;

a drying section at least one dryer for drying the fiber web to a desired moisture content;

a conveyor for transferring the fiber web through said wet end, said press section, said forming section and said drying section;

at least three sensors, each said sensor positioned in association with one of said approach flow system, said wet end, said press section, said forming section and said drying section, each said sensor configured to sense a physical characteristic of the fiber web and provide a signal indicative of the physical characteristic sensed thereby, each said physical characteristic comprising one of: formation; stock pH; stock temperature; zeta potential; consistency of one of the fiber suspension and fiber web; total pressure head; wire speed; flow rate to wet end; entrained air in stock; and tray water flow rate; and a chemistry process controller coupled with each said sensor and each said control module to define a closed loop control system, said chemistry process controller controlling operation of each said control module.

9. The paper machine of claim 8, wherein each of said sensors comprises one of a pressure sensor, gamma backscatter sensor, ultrasound sensor, optical sensor, temperature sensor and flow meter.

10. The paper machine of claim 8, wherein said chemistry process controller is respectively coupled with each said sensor and each said control module via at least one electrical conductor.

11. The paper machine of claim 1, wherein at least one of said sensors is configured to sense a different physical characteristic of the fiber web than another of said sensors.

12. The paper machine of claim 8, wherein at least one of said sensors is configured to sense a different physical characteristic of the fiber web than another of said sensors.

* * * * *